United States Patent [19]

Wass

[11] 4,120,281

[45] Oct. 17, 1978

[54] FIREPLACE HEAT EXCHANGER

[76] Inventor: Richard Wass, 376 Gorden Petty Ct., Brentwood, Tenn. 37027

[21] Appl. No.: 615,671

[22] Filed: Sep. 22, 1975

[51] Int. Cl.[2] ..... F24B 7/04

[52] U.S. Cl. ..... 126/121; 237/51

[58] Field of Search ..... 126/121, 122, 142, 139; 237/51; 417/14, 42, 326; 98/94

[56] References Cited

U.S. PATENT DOCUMENTS

| | | | |
|---|---|---|---|
| 1,537,736 | 5/1925 | Bennett | 126/121 |
| 2,371,398 | 3/1945 | Lamar | 126/121 |
| 2,787,997 | 4/1957 | Asbury | 126/121 |
| 2,975,388 | 3/1961 | Visos | 338/116 |
| 3,096,933 | 7/1963 | Bora | 98/94 X |
| 3,911,894 | 10/1975 | Richard, Jr. et al. | 126/121 |
| 3,930,491 | 1/1976 | Miller | 126/121 |

FOREIGN PATENT DOCUMENTS

| | | | |
|---|---|---|---|
| 1,344,299 | 10/1963 | France | 126/121 |
| 1,095,644 | 12/1967 | United Kingdom | 126/121 |
| 177,455 | 3/1922 | United Kingdom | 126/121 |

*Primary Examiner*—William F. O'Dea
*Assistant Examiner*—Harold Joyce

[57] ABSTRACT

A flexible tubular body with annular ribs defining an expanded heating surface and a pair of integral clamps constitute a heat exchanger that is mountable to a fireplace lintel. Opposite ends of the tubular body, which are exposed at oppposite sides of the fireplace opening, are provided with deflection grates for directing air flow. A panel extends across the fireplace opening at an upper region thereof and constitutes a smoke deflector. A thermostatically controlled, variable speed blower is contained within the tubular body for drawing cool air from the room and for exhausting heated air into the room, the cool air being heated within the tubular body by a fire in the fireplace.

10 Claims, 5 Drawing Figures

FIREPLACE HEAT EXCHANGER

BACKGROUND OF THE INVENTION

1. Field of Invention

The present invention relates to heating devices and more particularly to fireplace heaters.

2. Description of the Prior Art

It is well known that the heating efficiency of an open fire in a fireplce is extremely low. Most of the heat generated by the fire passes up the flue and only a small percentage of the heat generated passes into the room. Various devices, which have been designed to utilize the intense heat generated within the fireplace containing an open fire, have been introduced with varying degrees of success.

SUMMARY OF THE INVENTION

It is an object of the present invention to provide a heat exchanger for use with an existing fireplace which will greatly increase the heating efficiency of the fireplace. The heat exchanger includes a flexible tubular body with annular ribs that define an expanded heating surface as well as supporting members. A pair of clamps at opposite ends of the tubular body are provided for mounting the heat exchanger to a fireplace lintel, the tubular body being disposed horizontally at an upper region of the fireplace chamber with the tubular body ends exposed at opposite sides of the fireplace opening, one of the ends defining an inlet port and the other end defining an outlet port. A panel which extends across the entire fireplace opening at an upper region thereof constitutes a smoke deflector, the ends of the tubular body project through holes formed in the panel. A deflection grate is fitted over each end of the tubular body for directing air flow. A thermostatically controlled, variable speed blower is housed within the tubular body adjacent the inlet port for drawing cool air from the room and for exhausting heated air through the outlet port into the room, the cool air being heated as it passes within the tubular body by an open fire in the fireplace.

Other objects of the present invention will in part be obvious and will in part appear hereinafter.

The invention accordingly comprises the devices, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
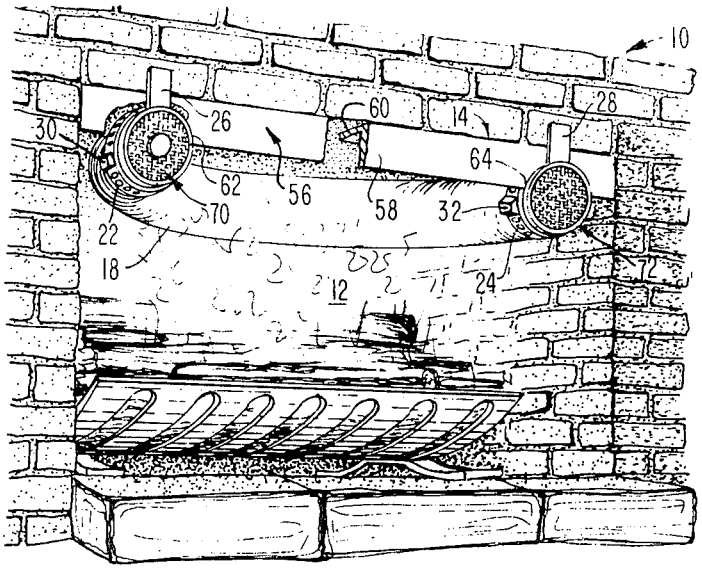
FIG. 1 is a perspective view of a heat exchanger embodying the invention in a fireplace.
Figure 2:
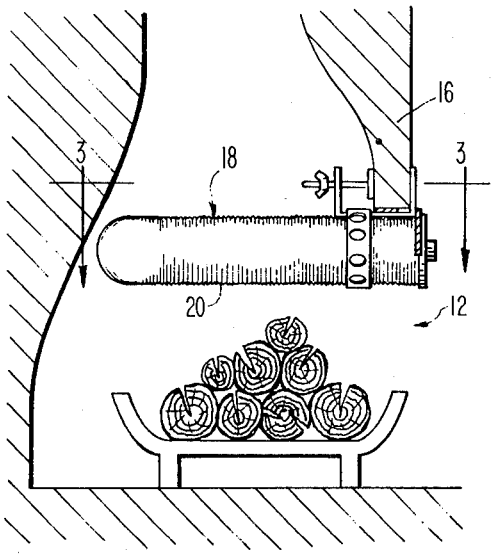
FIG. 2 is a sectional view taken along the lines 2—2 in FIG. 1.

Referring now to the drawings, particularly FIGS. 1 and 2, there is shown a fireplace 10 having an opening 12 in which there is mounted a heat exchanger 14 embodying the present invention. Heat exchanger 14 is mounted to a lintel 16 which extends across the top of opening 12. Heat exchanger 14 includes a continuous flexible tubular body 18 having annular ribs 20 which constitute an expanded heating surface. Tubular body 18 is composed of a metal that will withstand a temperature range of 1500° F to 2500° F without exhibiting any deleterious effects, for example stainless steel, steel or aluminum. In the preferred embodiment, tubular body 18 is composed of stainless steel and withstands temperatures of 2000° F. The diameter of tubular body 18 typically is in the range of 4 inches to 8 inches and preferably 6 inches. The length of tubular body 18 is in the range of 2 feet to 8 feet and typically is 4 feet for standard fireplace openings. Typically, the wall thickness of tubular body 18 is in the range of 0.004 inch to 0.25 inch and preferably 0.12 inch. The peak to valley distance of ribs 20 typically is in the range of 0.015 inch to 0.5 inch and preferably 0.125 inch.

A pair of bands 22 and 24 are placed about opposite end margins of tubular body 18 for holding a pair of clamps 26 and 28, respectively. Each band 22 and 24 is provided with quick release latches 30 and 32, each latch having locked and unlocked positions. When the latch is in its unlocked position, its associated band is slidable and rotatable with respect to tubular body 18. When the latch is in its locked position, its associated band is fixed against movement relative to tubular body 18.

Figure 5:
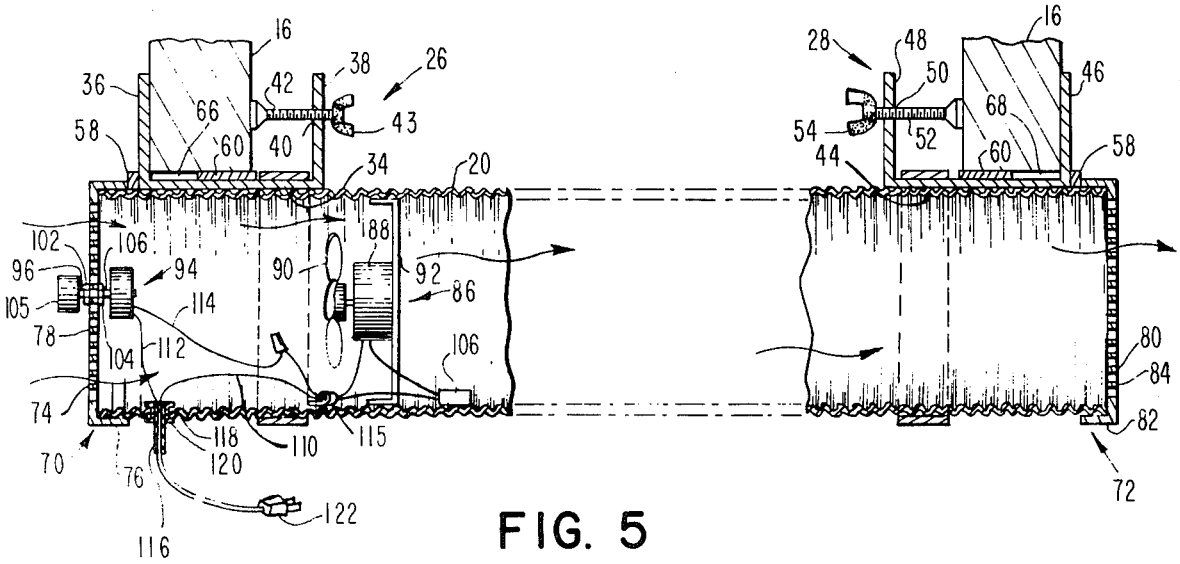
FIG. 5 is a sectional view taken along the lines 5—5 of FIG. 3.

As best shown in FIG. 5, clamp 26 has a substantially C-shaped profile in right cross section and includes a medial body 34 and a pair of legs 36, 38 which extend upwardly from opposite ends of body 34. Leg 38, the rear leg, is formed with a threaded hole 40 in which a screw 42 having a wind head 43 is turned. Clamp 28 has a sustantially C-shaped profile in right cross section and includes a medial body 44 and a pair of legs 46, 48 which extend upwardly from opposite ends of body 44. Leg 48, the rear leg, is formed with a threaded hole 50 in which a screw 52 having a wing head 54 is turned.

Figure 3:
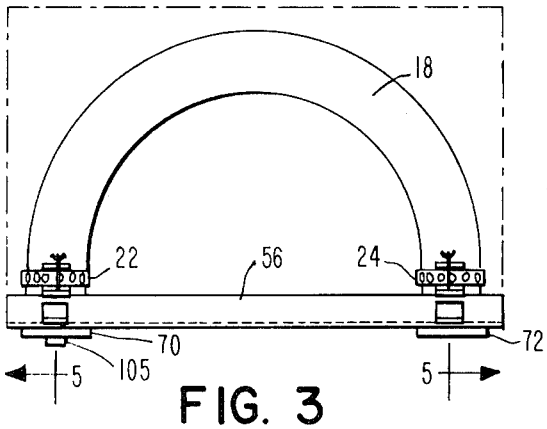
FIG. 3 is a top plan view of the heat exchanger of FIG. 1.

As previously indicated, heat exchanger 14 is mounted to lintel 16 of fireplace 10. Tubular body 18 is bent into a substantially U-shaped configuration and inserted into opening 12. Typically, the radius of curvature is in the range of 2 inches to 10 inches. As illustrated in FIG. 3, the bend of tubular body 18 is such that the inner most portion is near the rear wall of the fireplace and the ends of the tubular body are flush with the face of the fireplace. Latches 30 and 32 are placed in their unlocked positions, and screws 42 and 52 are loosened. Tubular body 18 is lifted to the upper portion of opening 12. Bands 22 and 24 are moved relative to tubular body 18 until clamps 26 and 28 are in registration with lintel 16 at opposite ends of opening 12. Clamps 26 and 28 are positioned so that they fit into lintel 16. That is, legs 36 and 46, the forward legs, are positioned at the front face of the fireplace and rearward legs 38 and 48 are at the back side of the lintel. Screws 42 and 52 are turned into their respective threaded hole for securing the clamps to the lintel. Then, latches 30 and 32 are locked for clamping tubular body 18 to lintel 16. Tubular body 18 is sufficiently flexible to be readily bent into the desired configuration and is sufficiently rigid to be supported in a substantially horizontal plane when the body ends are clamped to the fireplace lintel. Annular ribs 20 constitute stiffeners which provide support for tubular body 18.

Preferably, heat exchanger 14 includes a panel 56 which constitutes a smoke deflector and extends across opening 12. Panel 56 has a substantially L-shaped profile in right cross section and includes a skirt 58 and a flange 60. Skirt 58 is formed with a pair of openings 62, 64 which are in registration with the ends of tubular body 18. Flange 60 is formed with a pair of slots 66, 68 which are in registration with forward legs 36, 46, respectively. Smoke deflector 56 is mounted to lintel 16 by inserting legs 36 and 46 through slots 66, 68, the ends of tubular body 18 projecting through openings 62, 64. When clamps 26 and 28 are secured to lintel 16, flange 60 is sandwiched between the medial body of each clamp and the lintel. In the illustrated embodiment, openings 62 and 64 have a substantially semi-circular profile. Preferably, skirt 58 extends to the midpoint of tubular body 18 and spans the width of opening 12, the ends of the skirt in contact with the sides of opening 12.

The exposed ends of tubular body 18 are covered with caps 70 and 72 which are composed of a metal such as stainless steel, steel or aluminum and constitute air deflectors. Cap 70 includes a face plate 74 and an annular flange 76. Face plate 74 includes a plurality of interwoven strips 78 that define a mesh configuration. Annular flange 76 is configured to be snugly received about one end of tubular body 18. Cap 72 includes a face plate 80 and an annular flange 82. Face plate 80 includes a plurality of interwoven strips 84 that define a mesh configuration. Annular flange 76 is configured to be snugly received about the other end of tubular body 18.

In the illustrated embodiment, by way of example, the end of tubular body 18 to which cap 70 is attached constitutes an inlet port through which cool air enters and the end of tubular body to which cap 72 is attached constitutes an outlet port through which warm air exits. Cool air is drawn into the inlet port by means of a blower 86 which inclues a driver 88, for example a brush or brushless shaded pole AC motor, and a blade assembly 90. Motor 88 is mounted to the interior surface of tubular member 18 by means of a bracket 92 attached to the motor housing, blade assembly 90 facing cap 70. Blade assembly 90, for example ten blades assemblage, is operative to draw air into the inlet port. The amount of air drawn into the inlet port is governed by the speed at which blade assembly 90 is rotated by motor 88. A controller 94, for example a 0–350 ohm rheostat, regulates the speed of motor 88 and hence the flow of cool air into the inlet port. Rheostat 94 includes a shaft 96 which is connected to a wiper arm 98 of a resistor 100. Shaft 96 is received through an opening in face plate 74 and secured thereto by means of fasteners 102, 104, for example nuts that are turned onto a threaded sleeve 106 of the rheostat. The end of shaft 96 projects outwardly of cap 70, the body of rheostat 94 being disposed within tubular body 18. A knob 105 is mounted to the projecting end of shaft 96 for adjusting rheostat 94.

A sensor 106, for example a snap action bimetallic thermostat, is mounted to the interior surface of tubular body 18 approximately 10 inches to 15 inches from cap 70. Thermostat 106 is operative as a switch for energizing and deenergizing motor 88. Typically, thermostat 106 closes at a temperature rise in the range of 100° F to 140° F, and preferably 120° F, and opens at a temperature drop in the range of 80° F to 120° F and preferably at 100° F. That is, in the preferred embodiment, thermostat 106 closes when the ambient temperature about the thermostat rises to 120° F and opens when the ambient temperature drops to 100° F.

Figure 4:
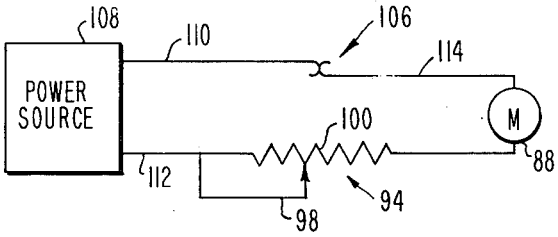
FIG. 4 is a schematic diagram.

As best shown in FIG. 4, power from a source 108 is applied to one side of thermostat 106 via a line 110 and is applied to one side of rheostat 94 via a line 112. The other side of thermostat 106 is connected to one side of motor 88 via a line 114 and the other side of motor 88. Preferably, lines 110, 112 and 114 have an outer covering composed of a high temperature resistance plastic consisting of a tetrafluoroethelyne polymer. A clamp 115 is provided for holding the lines away from blade assembly 90. A sleeve 116, composed of a high temperature resistant material, for example a plastic such as polyvinyl chloride, is placed about lines 110 and 112 as they exit through an opening 118 in tubular body 18. A grommet or strain relief 120, composed for example of rubber or plastic, is inserted into opening 118 to protect lines 110 and 112 against abrasion. The ends of lines 110 and 112 are connected to a male plug 122, which is adapted to be interconnected with source 108, for example a female socket.

In operation of heat exchanger 14, male plug 122 is inserted into female socket 108. Then, an open fire is started within opening 12, preferably the flames engulf the medial regions of tubular body 18. When the ambient temperature about thermostat 106 rises to approximately 120° F, the thermostat closes and motor 88 is energized. In consequence, blade assembly 90 rotates and cool air with the room is drawn inwardly through the inlet port. As the cool air passes through tubular body 18, it is heated by the open fire, whereby warm air is exhausted through the outlet port for warming the room. Knob 105 is rotated for controlling the air flow through tubular body 18. If the ambient temperature about thermostat 106 drops to approximately 100° F, the thermostat opens and motor 88 is deenergized.

Since certain changes may be made in the foregoing disclosure without departing from the scope of the invention herein involved, it is intended that all matter contained in the above description be construed in an illustrative and not in a limiting sense.

What is claimed is:

1. A heat exchanger for a fireplace comprising:

(a) a flexible tubular body with expanded interior and expanded exterior heating surfaces, said tubular body forming an elongated passage of generally circular cross section and having inlet and outlet ports at opposite ends, said tubular body having annular ribs defining said expanded interior heating surface which bounds said elongated passage and said expanded exterior heating surface on the outer periphery of said tubular body;

(b) clamp means mounted to each end of said tubular body and configured to be clamped to a lintel of the fireplace for securing said tubular body by its ends only to the lintel of the fireplace in a substantially horizontal plane, said tubular body having a substantially U-shaped profile when mounted to the lintel, said tubular body sufficiently flexible to be readily bent into said U-shaped configuration and sufficiently rigid to be self-supporting in said substantially horizontal plane when only its ends are mounted to the lintel by said clamp means;

(c) a cap mounted to each end of said tubular body and defining air deflectors;

(d) a blower mounted within said tubular body, said blower having energized and deenergized states, said blower operative to make air flow inwardly through said inlet port and outwardly through said outlet port when in said energized state;

(e) a controller electrically connected to said blower; and (f) a temperature sensor mounted to said tubular body, said temperature sensor having opened and closed states, said temperature sensor actuated into its closed state on a temperature rise in the range of 100° to 140° F. and is deactuated into its opened state on a temperature drop in the range of 80° to 120° F.;

(g) said blower, said controller and said temperature sensor electrically interconnected with one another, said temperature sensor operative to energize said blower when in said closed state, said temperature sensor operative to deenergize said blower when in said opened state, said controller operative to regulate the speed of said blower when said temperature sensor is in said closed state, said expanded exterior heating surface providing increased heat transfer between heated air in said fireplace and said tubular body, said expanded interior heating surface providing increased heat transfer between said tubular body and said air flowing in said tubular body.

2. The heat exchanger as claimed in claim 1 wherein said blower includes a motor and blade assemblage, said motor mounted within said tubular body adjacent said inlet port, said blower operative to draw air inwardly through said inlet port and to exhaust air outwardly through said outlet port, said air flowing across said interior expanded heating surface as its flows from said inlet port to said outlet port, and wherein each said clamp means includes a band disposed about said tubular body and a generally U-shaped clamp configured to receive said band and to engage the lintel, one of said band adjacent one end of said tubular body and the other of said bands adjacent an opposite end of said tubular body, said band provided with a latch having locked and unlocked positions, said band slidable and rotatable with respect to said tubular body when said latch is in its unlocked position, said band and said tubular body fixed against relative movement when said latch is in its locked position, said clamp secured to said tubular body by said band, said tubular body disposed in a substantially horizontal plane within the fireplace opening and suspended only by said band adjacent opposite ends of said tubular body.

3. The heat exchanger as claimed in claim 1 wherein said temperature sensor is a snap action bimetallic thermostat and wherein said controller is a rheostat constituting a variable impedance, said rheostat mounted to said cap at said inlet port, said rheostat having a shaft extending outwardly through said cap at said inlet port, said rheostat adjustable by rotating said shaft for controlling the speed of said blower for governing the amount of air passing through said tubular body.

4. The heat exchanger as claimed in claim 1 wherein said tubular body is composed of stainless steel that is capable of withstanding temperatures in the range of 1500° F to 2500° F.

5. The heat exchanger as claimed in claim 1 wherein said ribs have a peak to valley distance in the range of 0.015 inch to 0.5 inch.

6. A heat exchanger mountable in a fireplace opening, a lintel disposed across the opening at an upper edge thereof, said heat exchanger comprising:

(a) a flexible tubular body with expanded interior and exterior heating surfaces, said tubular body forming an elongated passage of generally circular cross section and having an inlet port and an outlet port at opposite ends, said tubular body having annular ribs defining said expanded interior heating surface which bounds said elongated passage and said expanded exterior heating surface on the periphery of said tubular body;

(b) a panel extending across an upper region of the fireplace from one side of the opening to an opposite side of the opening;

(c) a pair of fastening means mounted to said tubular body, one of said fastening means mounted to said body adjacent said inlet port and the other of said fastening means mounted to said body adjacent said outlet port, said fastening means supporting said panel, said tubular body supported within the fireplace opening at an upper region thereof by clamping said fastening means to the fireplace lintel, said tubular body disposed in a substantially horizontal plane and supported within said fireplace opening only at its ends by said fastening means, said tubular body being sufficiently flexible to be bent into a substantially U-shaped configuration for insertion into the fireplace opening with said inlet and outlet ports being substantially flush with a face of the fireplace and sufficiently rigid to be self-supportingly disposed in said substantially horizontal plane when supported from its ends by said fastening means;

(d) a cap having interwoven strips defining a mesh configuration mounted to each end of said tubular body;

(e) a blower mounted within said tubular body adjacent said inlet port, said blower having energized and deenergized states, said blower operative to make air flow inwardly through said inlet port and outwardly through said outlet port when in said energized state;

(f) a controller mounted to said cap at said inlet port; and (g) a snap action bimetallic thermostat mounted to said tubular body, said thermostat having opened and closed states, said thermostat actuated to its closed state at a temperature rise in the range of 100° F. to 140° F. and actuated to its opened state at a temperature drop in the range of 80° F. to 120° F.;

(h) said blower, said controller and said thermostat electrically interconnected with one another, said thermostat operative to energize said blower when in said closed state, and thermostat operative to deenergize said blower when in said opened state, said controller operative to regulate the speed of said blower when said thermostat is in said closed state, said expanded exterior heating surface providing increased heat transfer between heated air in said fireplace and said tubular body, said expanded interior heating surface providing increased heat transfer between said tubular body and said air flowing in said tubular body.

7. The heat exchanger as claimed in claim 6 wherein said flexible tubular body is composed of stainless steel which is capable of withstanding temperatures in the range of 1500° F to 2500° F.

8. The heat exchanger as claimed in claim 7 wherein each said fastening means includes a band and a clamp, said band mounted about said tubular body, said clamp secured to said tubular body by said band, said clamp configured to engage the lintel, said band provided with a latch having locked and unlocked positions, said band slidable and rotatable with respect to said tubular body when said latch is in its unlocked position, said band and said tubular body fixed against relative movement when said latch is in its locked position, a portion of said clamp disposed between said band and said tubular body, said clamp movable relative to said tubular body when said band is movable relative to said tubular body, said clamp fixed against movement relative to said tubular body when said band is fixed against movement relative to said tubular body.

9. The heat exchanger as claimed in claim 8 wherein said panel has a substantially L-shaped profile in right cross section and inclues a skirt and a flange, a portion of said flange sandwiched between a bottom face of the lintel and said tubular body by said clamps, said skirt formed with openings configured to receive opposite ends of said tubular body, said skirt disposed in a substantially vertical plane at the ends of said tubular member.

10. The heat exchanger as claimed in claim 9 wherein said ribs have a peak to valley distance in the range of 0.015 inch to 0.5 inch.

* * * * *